United States Patent [19]

Callahan et al.

[11] Patent Number: 4,693,026

[45] Date of Patent: Sep. 15, 1987

[54] CHANGEABLE MESSAGE OUTDOOR ADVERTISING SIGN

[75] Inventors: David T. Callahan; David W. Dobyns, both of Lynchburg, Va.

[73] Assignee: Allen-Morrison, Inc., Lynchburg, Va.

[21] Appl. No.: 899,376

[22] Filed: Aug. 14, 1986

[51] Int. Cl.[4] ..... G09F 13/04

[52] U.S. Cl. ..... 40/576; 40/618

[58] Field of Search ..... 40/618, 564, 575, 576, 40/489, 446

[56] References Cited

U.S. PATENT DOCUMENTS

| | | | |
|---|---|---|---|
| 1,116,628 | 11/1914 | Reith et al. | 40/576 |
| 1,159,465 | 11/1915 | Brandenburg | 40/576 |
| 1,841,026 | 1/1932 | Greenstone | 40/576 |
| 1,853,703 | 4/1932 | Send | 40/618 |
| 1,936,634 | 11/1933 | Lorraine | 40/618 |
| 2,725,652 | 12/1955 | Elliot | 40/618 |
| 2,798,323 | 7/1957 | Witz | 40/576 |
| 4,237,637 | 12/1980 | Bourbon | 40/618 |
| 4,263,736 | 4/1981 | Beierwaites et al. | 40/576 |

*Primary Examiner*—Gene Mancene
*Assistant Examiner*—Wenceslao J. Contreras
*Attorney, Agent, or Firm*—Mason, Fenwick & Lawrence

[57] ABSTRACT

An internally illuminated sign structure wherein the message is formed by interchangeable panels.

20 Claims, 10 Drawing Figures

CHANGEABLE MESSAGE OUTDOOR ADVERTISING SIGN

BACKGROUND AND OBJECTS OF THE LNVENTION

The present invention relates in general to changeable message outdoor advertising signs, of a type frequently referred to as perimeter signs, and more particularly to internally illuminated changeable message outdoor advertising signs having changeable letter panels providing clear transparent alpha-numeric characters and a translucent background.

Many internally illuminated changer:ble message outdoor advertising signs have been heretofore used in the trade, having plastic letters that have a clear background and colored characters, and some have employed a solid background with a clear character letter, but in both cases there are considerable light leak problems unless the letters have an opaque or light attenuating background. These have usually involved substantially rectangular thin letter panels forming the fonts or letters which are either alphabet characters or numeric characters, with the characters being colored numerals or alphabet characters on a clear background or clear character numerals or letters on an opaque background, wherein the rectangular font or letter panels are supported in either a pair of horizontal tracks horizontally spanning the width of the sign face at each side of the sign, or wherein a horizontal track member and a pair of associated vertical track members spaced apart substantially the width of the font or letter panel form a pocket for each letter along the sign face. Bevelite-Adler, a Gardena, California company, has offered signs wherein the letters or characters appear to be clear transparent characters associated with an opaque background by silk screening the front and back of the associated panel, and wherein bevelled edges are provided so that there is a slight overlap at the vertical edges of the letter panels. Again, light leak problems arise in connection with this arrangement due to inability to keep the vertical overlapped edges of the letter panels in an arrangement which prevents any light leakage.

An object of the present invention is the provision of a novel internally illuminated changeable message outdoor advertising sign and the like, having changeable plastic letters that have a translucent background with clear characters and have no light leaks on the face of the sign.

Another object of the present invention is the provision of an internally illuminated changeable message outdoor advertising sign employing a plurality of substantially rectangular plastic font or letter panels with bevelled edges abutting each other arranged along horizontally extending tracks, and wherein the letter panels provide for a translucent background by silk screening the letters or characters on the back surface of the letter panel, and wherein tensioning devices are provided bearing against one or both ends of each horizontal row of font or letter panels maintaining the bevelled vertical edges thereof in tightly abutting relation to prevent light leaks.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
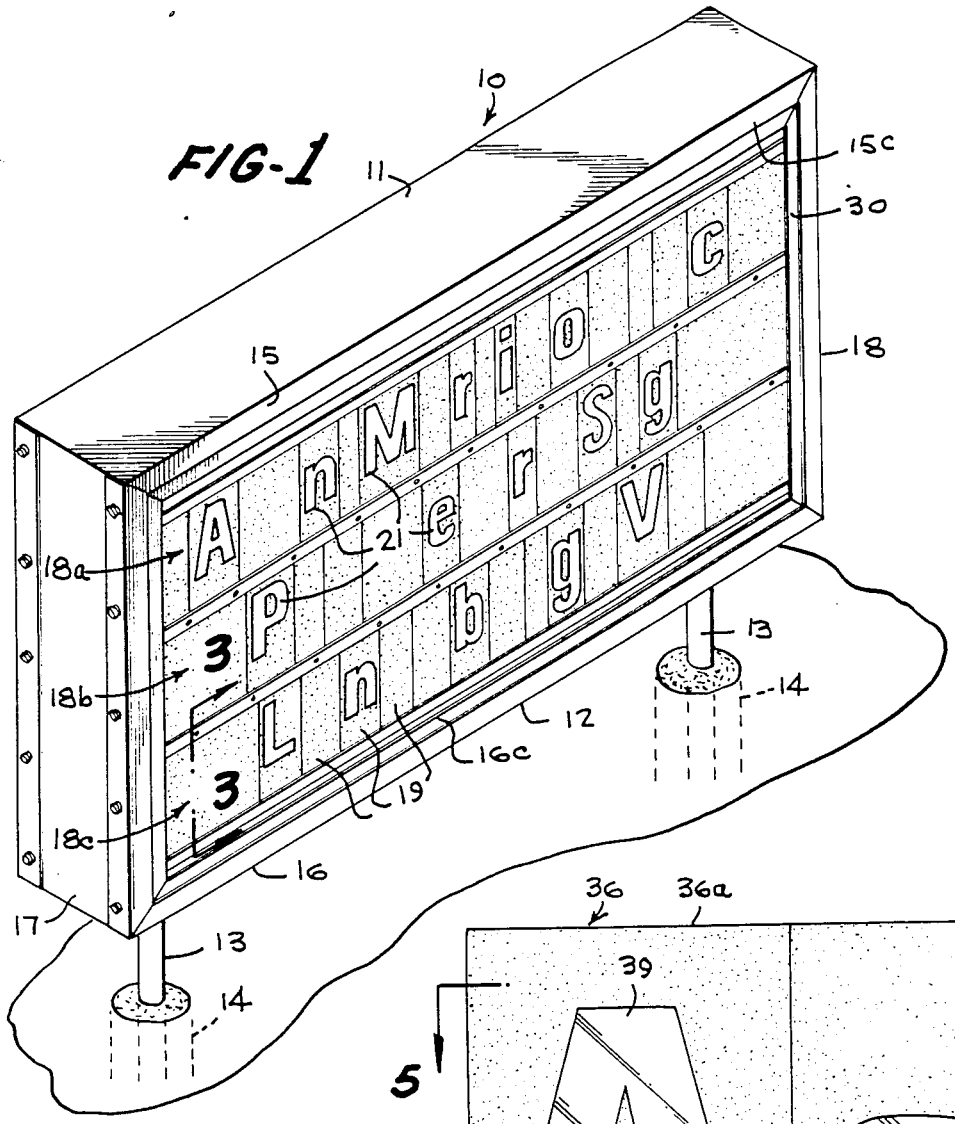
FIG. 1 is an elevational view of an internally illuminated changeable message outdoor display sign embodying the present invention.
Figure 4:
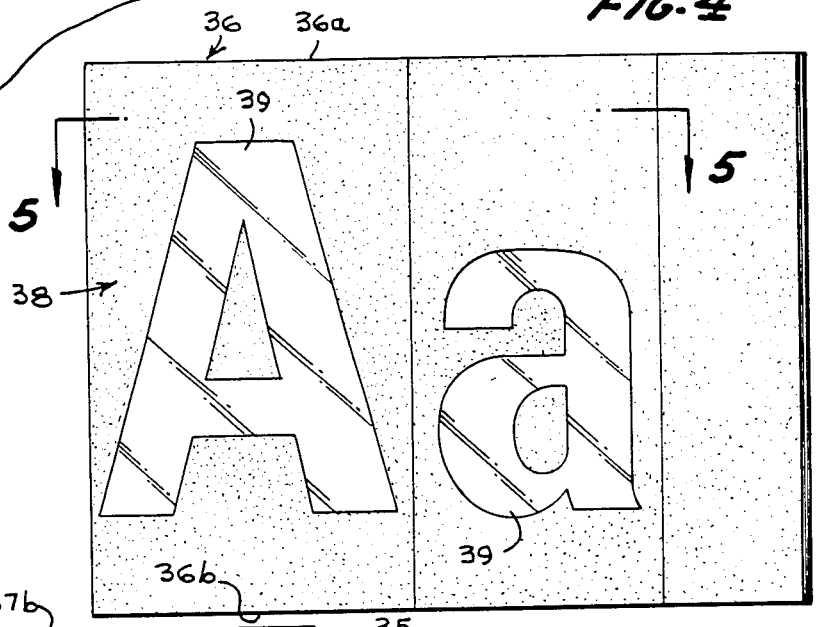
FIG. 4 is a front elevational view of an upper case and lower case font panel and spacer panel to be mounted in the tracks of the sign.

Referring to the drawings, wherein like referenced characters designate corresponding parts throughout the several figures, there is illustrated an internally illuminated, changeable message advertising or display sign 10 which, in the illustrated embodiment, is of the stationary installation type, having a rectangular main sign body 11 bounded at the top and bottom and at the two ends by a rectangular frame 12 and having downwardly extending pedestal or post members 13, for example embedded in concrete piers 14 meeting the requirements of local codes. It will be understood that the sign, herein sometimes referred to as a perimeter sign, may be mounted on a high pedestal or plural post structure to make it visible from significant distances along a highway or similar location, or may be mounted on a mobile support structure such as a supporting leg substituted for one of the post members 13 which merely bears gravitationally against the ground or flat supporting surface and having a wheel or trolley assembly adjacent the other end to permit the sign to be moved about to different locations.

Figure 6:
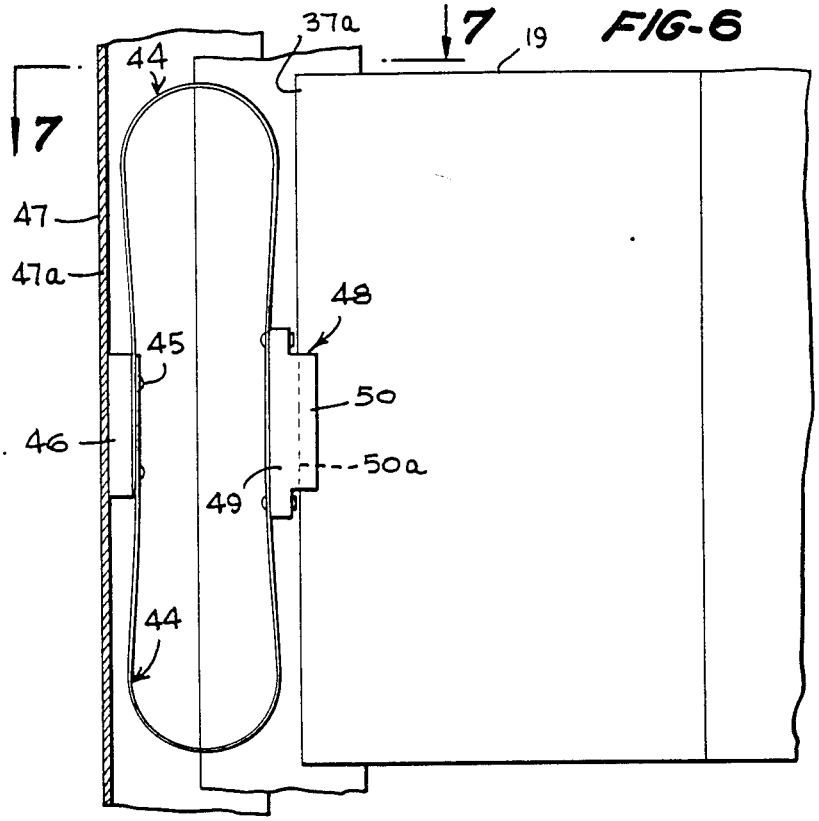
FIG. 6 is a fragmentary front elevational view of the tensioning device and adjacent end portion of the sign and the adjacent edge of a font or letter panel, taken along the line 6—6 of FIG. 1, with the sign frame structure located outwardly of the tension device and font panel removed.
Figure 7:
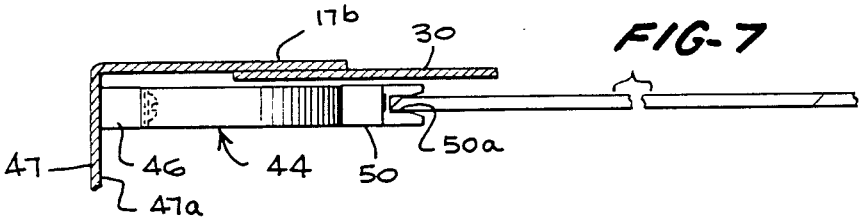
FIG. 7 is a fragmentary horizontal section view taken along the line 7—7 of FIG. 6.
Figure 8:
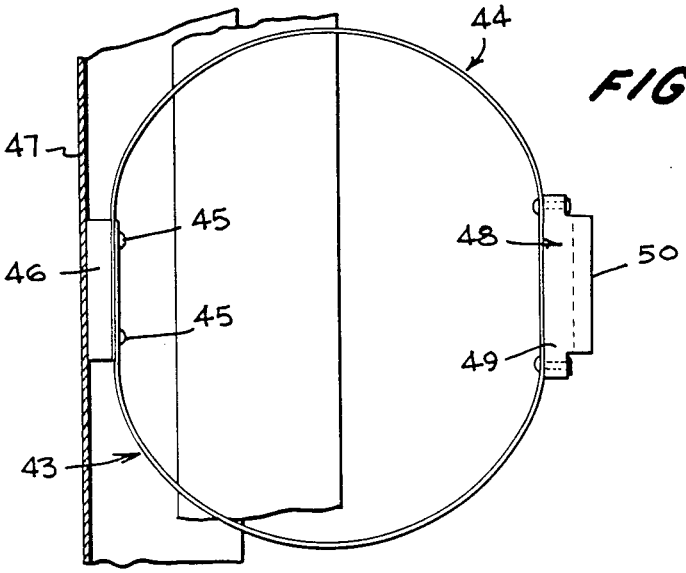
FIG. 8 is a somewhat diagrammatic view of the tension device, showing the tension spring structure in a no load condition.

In the illustrated embodiment, the main sign body 11 is enclosed by a top cover member 15, a bottom cover member 16, and two end cover members 17, one of which is shown in FIGS. 6 and 7, each of which are of channel shaped configuration having a flat base wall, for example as shown at **17*a*, extending for the full thickness of the main sign body and terminating at opposite front and rear edges in flange members, indicated at 17*b*, which may either be angled at 45° angles at the top and bottom or may be rectangular and overlap similar flanges 15*b* and 16*b* of the top and bottom cover members 15 and 16. These members, together with border members for the top and bottom cover members and end cover members, if desired, such as indicated at 15***c* and 16*c* in FIG. 2, frame the two opposite faces of the sign, one of the faces being indicated generally by the reference character 17.

In the illustrated embodiment, the sign comprises three horizontal rows, indicated at 18*a*, 18*b* and 18*c*, of letters which are internally illuminated as later described, the letters being formed by clear transparent characters, which may be either alphabetic characters or numeric characters, or the like, formed on font or letter panels or spacer panels 19 of generally rectangular configuration which are provided with silk screen translucent coloring, for example of a blue coloring, indicated at 20 on the rear face 19*a* only thereof.

These three rows of font or letter panels 19 forming rows 18*a*, 18*b* and 18*c* may involve all upper case letters and numerals or upper case and lower case alphabetic characters, as desired, and also will involve some spacer panels which are silk screen coated on the rear face 19*a* thereof with no transparent light passing zones. A few representative alpha-numeric characters formed by the font or letter panels 19 are indicated in broken lines at 21 in the drawings.

Figure 2:
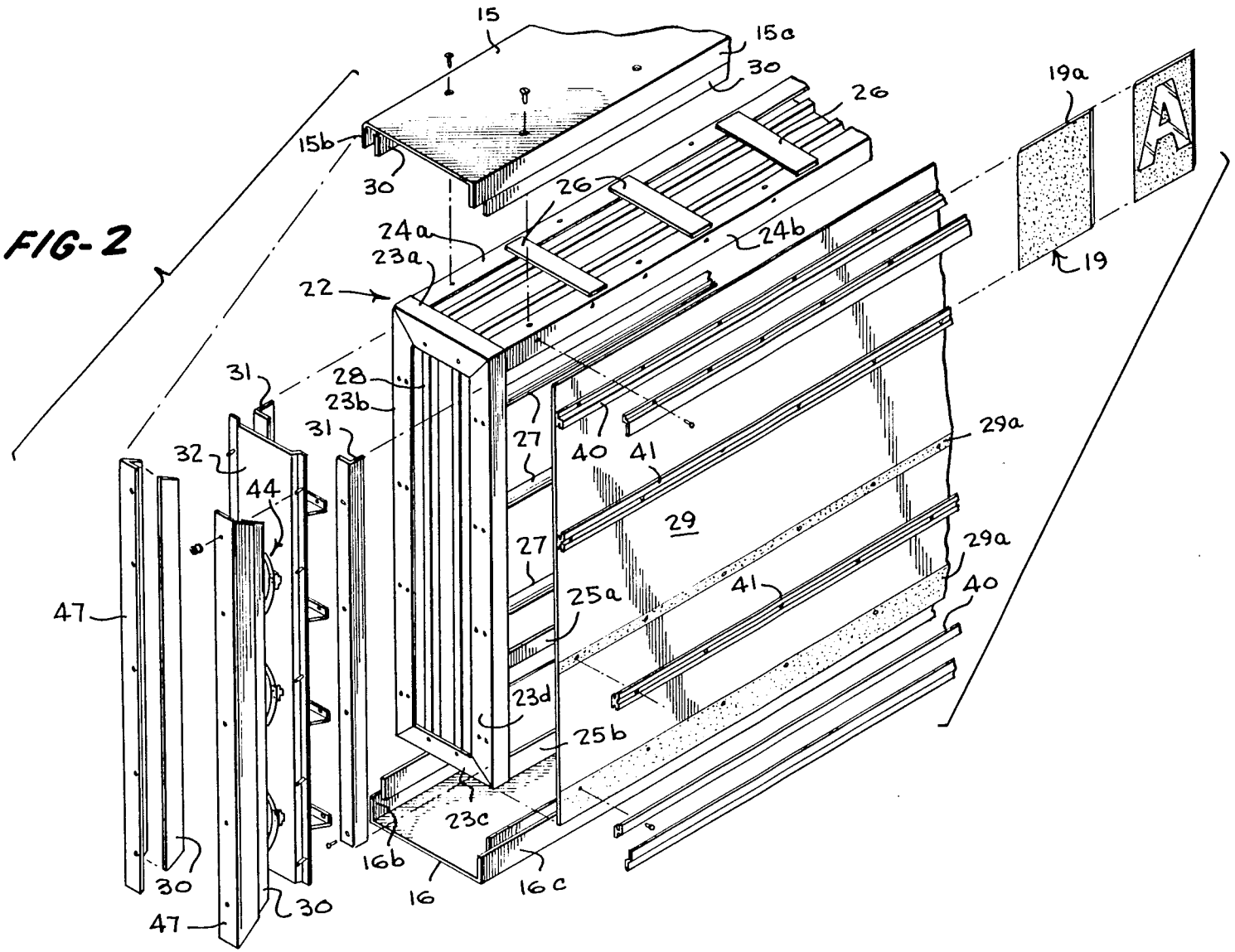
FIG. 2 is a fragmentary exploded perspective view of a portion of the sign extending from one end thereof toward the mid region of the sign.
Figure 3:
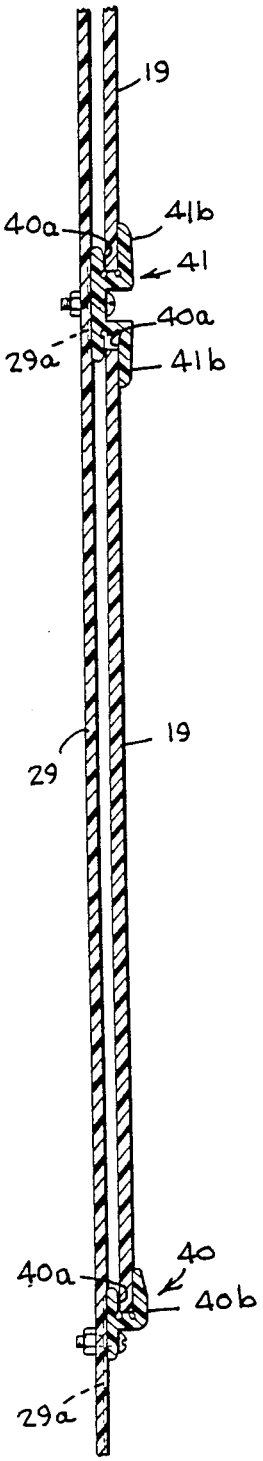
FIG. 3 is a fragmentary section view through one face of the sign and a lower row of font or letter panels and the track structure therefor, taken along the line 3—3 of FIG. 1.

As will be apparent from FIG. 2, the interior structure of the sign is formed basically by an aluminum structural frame, indicated at 22, having a rectangular frame formed of right angle aluminum frame members 23*a*–23*d* at each end thereof, horizontally extending aluminum structural frame right angle members 24*a* and 24*b* at the top thereof, and 25*a* and 25*b* at the bottom thereof, together with cross-bracing straps or plates 26, some of which are shown in FIG. 2, extending across the top and bottom of the frame 22 between the frame members 24*a*, 24*b* and 25*a*, 25*b*. Florescent lamp tubes 27, three of which are shown in FIG. 2, fitted in conventional end fixtures for fluorescent lamps are provided, substantially along the horizontal mid line for the rows 18*a*, 18*b* and 18*c*, and electric wire raceways, indicated at 28 in FIG. 2 are provided at opposite ends of the frame 22 to provide wiring connections to the fittings for the fluorescent lamps and to connect them to an external 110 volt power supply source.

A pair of white acrylic sheets, indicated at 29, covering each of the opposite sides of the frame structure 22 and providing support for tracks for the letter panels 19, are fixed against the flanges of the frame members 24*a*, 24*b*, 25*a*, 25*b*, and the end frame members 22 and are held against the confronting surfaces of the vertical flanges of such frame members by the flanges 15*b* and 16*b* and their associated white borders 15*c*, 16*c* and 30, if it is desired to provide such borders for aesthetic purposes, and also are held by the clamp angle members 31 at the opposite ends of the frame structure. The clamp angles 31 are held against the vertical surface flanges of the end frame members 23 by an end plate 32 and suitable screws extending through holes or slots in the edge portions of the end plates 32 and into the horizontal surface flanges of the end frame members 23. End angles with letter tensioning devices, as later described, are provided, mounted at the vertical edges of the end plate members 32 to maintain the font or letter panels 19 in tightly abutting relationship to prevent light leaks.

Figure 5:
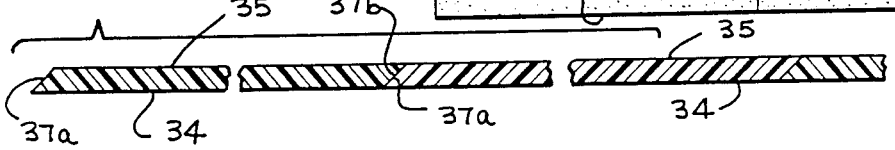
FIG. 5 is a fragmentary section view taken along the lines 5—5 of FIG. 4.
Figure 5A:
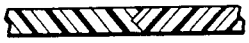
FIGS. 5A and 5B are fragmentary top plan views of the adjacent edge portions of alternate edge shapes of the panels.
Figure 5B:
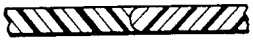

As will be apparent from FIGS. 2, 5 and 6, the font or letter panels 19 are thin plastic panels of rectangular configuration having a front face 34, a rear face 35, top and bottom edges 36*a*, 36*b* which are flat edges lying in planes perpendicular to the planes of the front and rear faces 34, 35 which are parallel to each other. The vertical edges 37*a*, 37*b* are mitered or bevelled, at an approximately 45° angle to the planes of the front face 34 and rear face 35, along parallel planes, so that they butt tightly against each other, as shown in FIG. 5, so as to not allow any light to pass through the acrylic plastic material of the plastic font or letter panels 19. Alternatively, the abutting vertical edges of the panels may be complementary V-shaped tongue and groove shapes or complementary convex and concave shaped interfitting edges shown in FIGS. 5A and 5B. In the preferred embodiment, the acrylic font or letter panels 19 are silk screened on the rear face 35 only, with a translucent color, such as a blue color, with the alphabetical character or numeral remaining clear, so that, upon back lighting produced by the fluorescent tubes 27, a blue colored defused light passes through the translucent zone, indicated at 38 in FIG. 6, while the clear transparent acrylic alphabetical or numeric characters, indicated at 39, readily transmit light from the fluorescent tubes. The acrylic font or letter panels 19 are supported against the white acrylic backing sheet 29 of the associated face of the sign by extruded track members, which are preferably extruded acrylic tracks, including single track forming upper and lower track members 40 defining recessed trackways 40*a* bounded forwardly by front flanges 40*b*, and intermediate double track members 41 forming a pair of recessed grooves 41*a* to receive the upper or lower edges of the font or letter panels 19 and front flange formations 41*b* spaced forwardly of the acrylic backing sheet 29 to restrain the font or letter panels 19 in position.

The plurality of acrylic font or le±ter panels 19 for each row are held in tightly abutting relation with their bevelled or mitered edges 37*a*, 37*b* fitted against each other by a tension device, generally indicated at 43, best shown in FIGS. 2, 6, 7 and 8. As shown, the tension devices 43 comprise an oval or somewhat eliptically shaped spring strap member 44, shown in its no load position in FIG. 8, and shown in its compressed active position in FIGS. 6 and 7. The tensioning spring strap 44 is secured by fasteners such as screws 45 to a mounting block 46 fixed, in the illustrated embodiment, to end angle members 47 of the sign, which form the outer frame members at one end of the sign and, like the bottom flanges 16*b* and top flanges 15*b* may carry white border strips 30. The diametrically opposite portions of the tensioning spring strap members 45 are fastened to a molded nylon bracket member 48 having a body portion 49 fixed to the spring strap member 44 associated therewith and having a forwardly projecting grooved yolk formation 50 defining a groove 50*a* sized to correspond substantially to the thickness of the font or letter panels 19 and receive the adjacent vertical edge 37*a* of the nearest font or letter panel 19 therein for transferring the pushing force from the spring strap 44 to the row of font or letter panels to maintain them in tightly abutting relation to each other. If desired, a similar tensioning mechanism may be provided at the opposite end of the row, or the opposite end of the row may simply be provided with an abutment block, provided if desired with a groove for receiving the adjacent edge of the nearest font or letter panel 19 therein.

With this arrangement, it will be seen that the screening on the back of the letter panels, the mitering or bevelling of the edges of the panels and the joining or positioning of them in tightly abutting relation, with the tension provided by the tension devices on the end angles, light leaks for the abutting edges of the font or letter panels are avoided. In the preferred embodiment, opaque print areas are provided on the acrylic backing sheet 29 at the locations indicated at 29*a* associated with the intermediate double track members 41 and the top and bottom single track members 40, and extend below the bottom track member 40 and above the top track member 40 to exclude light in the region of the fastener devices for the track members and in the regions above and below the top and bottom track members respectively, so that only white light is transmitted through the clear transparent character or numeral areas cf the panels. These print areas 29*a* may, if desired, be screened areas in the same translucent color as the translucent screening on the back surfaces of the font or letter panels 19 so that all areas of the sign within the bounding frame, except for the clear transparent character or numeral portions, are of the same color as that produced by the translucent screening on the backs of the font or letter panels 19.

We claim:

1. A changeable message outdoor advertising sign or the like, comprising a generally rectangular frame forming top, bottom and end walls defining a rectangular surround for an internally illuminated sign section having an interior lamp chamber, a pair of light transmissive thin backing sheet members supported within and spanning the height and horizontal length of the frame and located in spaced apart parallel planes forming opposite faces of the sign, pairs of horizontal track members supported above and below vertically spaced horizontal axes traversing said faces defining plural horizontal rows for displaying plural visible illuminated characters forming messages, a plurality of thin rectangular font panels having parallel planiform front and back surfaces and parallel horizontal edges and parallel vertical edges to be positioned and slidably supported in vertical edge abutting relation with their horizontal edges slidable supported in said tracks between pairs thereof associated with each of said rows and against said backing sheet members, the font panels having clear transparent character image forming areas and having the remainder of each panel of diminished light transmission attenuating properties to render readily visible the characters to be displayed by the image forming areas, the vertical edges of said font panels being shaped in confronting pairs to interfit intimately with each other along paths inclined in non-perpendicular relation to the planes of said front and back surfaces of said font panels, and tension means at each of said rows having a stationary mounting base member supported adjacent an end wall of said frame and a force transfer bracket member for engaging the nearest edge of the adjacent font panel in the associated row and a spring member connected between said base member and bracket member to be compressed by font members arrayed in the associated row and exert spring pressure thereon maintaining the confronting pairs of vertical edges of the font panels in light-leak-resisting interfitting relation.

2. A changeable message sign as defined in claim 1, wherein the vertical edges of each of said font panels have their outwardly facing surfaces disposed in inclined parallel vertical planes forming corresponding acute angles with the planes of said front and back surfaces defining bevelled edge surfaces to intimately abut confronting bevelled edge surfaces of adjacent font panels in lapping relation and minimizes light-leaks at said edges.

3. A changeable message sign as defined in claim 1, wherein the vertical edges of said font panels define complementing V-shaped tongue and groove edges to interfit such tongues on one vertical edge of each font panel in a groove of the confronting vertical edge of an adjacent abutting font panel.

4. A changeable message sign as defined in claim 1, wherein the vertical edges of said font panels define complementing concave and convex tongue and groove edges to interfit such tongues on one vertical edge of each font panel in a groove of the confronting vertical edge of an adjacent abutting font panel.

5. A changeable message sign as defined in claim 1, wherein said spring member is a spring strap which normally lies in an oval-shaped path extending between and connected to said mounting base member and said bracket member and is compressed to a stressed position with opposite portions thereof connected to said last mentioned members located closer together when the font panels are positioned in said rows.

6. A changeable message sign as defined in claim 2, wherein said spring member is a spring strap which normally lies in an oval-shaped path extending between and connected to said mounting base member and said bracket member and is compressed to a stressed position with opposite portions thereof connected to said last mentioned members located closer together when the font panels are positioned in said rows.

7. A changeable message sign as defined in claim 3, wherein said spring member is a spring strap which normally lies in an oval-shaped path extending between and connected to said mounting base member and said bracket member and is compressed to a stressed position with opposite portions thereof connected to said last mentioned members located closer together when the font panels are positioned in said rows.

8. A changeable message sign as defined in claim 4, wherein said spring member is a spring strap which normally lies in an oval-shaped path extending between and connected to said mounting base member and said bracket member and is compressed to a stressed position with opposite portions thereof connected to said last mentioned members located closer together when the font panels are positioned in said rows.

9. A changeable message sign as defined in claim 5, wherein said bracket member has a U-shaped yoke formation along a vertical end thereof confronting the adjacent vertical edge of an end-most font panel of the associated row of font panels, the yoke formation defining a groove facing the vertical edge thereof to receive the same therein over a substantial position of the height of such edge.

10. A changeable message sign as defined in claim 6, wherein said bracket member has a U-shaped yoke formation along a vertical end thereof confronting the adjacent vertical edge of an end-most font panel of the associated row of font panels, the yoke formation defining a groove facing the vertical bevelled edge thereof to receive the same therein over a substantial position of the height of such edge.

11. A changeable message sign as defined in claim 7, wherein said bracket member has a U-shaped yoke formation along a vertical end thereof confronting the adjacent vertical edge of an end-most font panel of the associated row of font panels, the yoke formation defining a groove facing the vertical groove or tongue edge thereof to receive the same therein over a substantial position of the height of such edge.

12. A changeable message sign as defined in claim 7, wherein said bracket member has a U-shaped yoke formation along a vertical end thereof confronting the adjacent vertical edge of an end-most font panel of the associated row of font panels, the yoke formation defining a groove facing the vertical groove or tongue edge thereof to receive the same therein over a substantial position of the height of such edge.

13. A changeable message sign as defined in claim 1, wherein the rear surface only of the panels is provided with a silk screened area of a translucent color throughout the area of said rear surface not occupied by the character image forming area thereof.

14. A changeable message sign as defined in claim 2, wherein the rear surface only of the panels is provided with a silk screened area of a translucent color throughout the area of said rear surface not occupied by the character image forming area thereof.

15. A changeable message sign as defined in claim 3, wherein the rear surface only of the panels is provided with a silk screened area of a translucent color throughout the area of said rear surface not occupied by the character image forming area thereof.

16. A changeable message sign as defined in claim 4, wherein the rear surface only of the panels is provided with a silk screened area of a translucent color throughout the area of said rear surface not occupied by the character image forming area thereof.

17. A changeable message sign as defined in claim 9, wherein the rear surface only of the panels is provided with a silk screened area of a translucent color throughout the area of said rear surface not occupied by the character image forming area thereof.

18. A changeable message sign as defined in claim 10, wherein the rear surface only of the panels is provided with a silk screened area of a translucent color throughout the area of said rear surface not occupied by the character image forming area thereof.

19. A changeable message sign as defined in claim 11, wherein the rear surface only of the panels is provided with a silk screened area of a translucent color throughout the area of said rear surface not occupied by the character image forming area thereof.

20. A changeable message sign as defined in claim 12, wherein the rear surface only of the panels is provided with a silk screened area of a translucent color throughout the area of said rear surface not occupied by the character image forming area thereof.

* * * * *